United States Patent [19]

Wang

[11] Patent Number: 4,537,324

[45] Date of Patent: Aug. 27, 1985

[54] AUTOMATIC STRAW-EMERGING DEVICE FOR EASY-TO-OPEN BEVERAGE CAN OF PRESS-DOWN TYPE SEALING TAP

[76] Inventor: Ming-Sheng Wang, No. 6, 77 La., An Ho Rd., Taipei, Taiwan

[21] Appl. No.: 668,793

[22] Filed: Nov. 6, 1984

[51] Int. Cl.[3] ..... A47G 19/22

[52] U.S. Cl. ..... 220/90.2; 215/1 A; 229/7 S

[58] Field of Search ..... 220/90.2; 229/7 S; 215/1 A

[56] References Cited

U.S. PATENT DOCUMENTS

| | | | |
|---|---|---|---|
| 3,226,001 | 12/1965 | Sequeira | 215/1 A X |
| 3,263,855 | 8/1966 | Pugh, Sr. | 215/1 A X |
| 3,486,679 | 12/1969 | Pfahler | 215/1 A X |
| 3,559,868 | 2/1971 | Chang | 215/1 A X |
| 3,656,654 | 4/1972 | Brinkley, III | 215/1 A X |
| 3,717,476 | 2/1973 | Harvey | 229/7 S X |
| 4,078,692 | 3/1978 | Stein | 215/1 A X |
| 4,194,674 | 3/1980 | Pearson | 215/1 A X |
| 4,226,356 | 10/1980 | Lemelson | 220/90.2 X |
| 4,305,521 | 12/1981 | Komatsuta et al. | 229/7 S X |
| 4,356,927 | 11/1982 | Cooper | 215/1 A X |
| 4,424,913 | 1/1984 | Ko | 215/1 A X |
| 4,462,503 | 7/1984 | Di Raffaele | 215/1 A X |

*Primary Examiner*—Steven M. Pollard

*Attorney, Agent, or Firm*—Bacon & Thomas

[57] ABSTRACT

This invention relates to a device which enables a straw to be incorporated in a beverage can provided with a non-detaching top sealing tap. When the can is in sealed state, the top end of the straw incorporated in the can is located in the vicinity of the opening sealed by the sealing tap, and when the can is opened, it is pulled to the opening and emerges therefrom without the likelihood of being hindered by the sealing tap.

5 Claims, 11 Drawing Figures

AUTOMATIC STRAW-EMERGING DEVICE FOR EASY-TO-OPEN BEVERAGE CAN OF PRESS-DOWN TYPE SEALING TAP

This invention relates to an improved type of straw retaining device in a beverage can in which a straw is provided.

Prior to this invention, the same applicant has an application to the U.S. Patent Office in the title of "built-in straw", in which a straw is incorporated in a can of beverage. It has many advantages over the conventional straw which are available as a separate part of the can beverage. It eliminates the inconvenience due to the unavailability of a straw when one is to consume a can of beverage, which would otherwise have to be drunk by directly decanting the content into the consumer's mouth. Such manner is unpleasant and unsightly, and the consumer's dress is likely to be contaminated by overflowing liquid. Moreover, his mouth is directly in contact with the surface of the can, which has been exposed to the air for a long time and may gather dusts, dirts, or microbes. Even if a straw is available, if not freshly taken out from a seal, the straw may be subject to like contamination due to long term exposure to the air. Both of the two cases may be harmful to the consumer's health. Various means were suggested to enable the upper end of the straw to emerge out of the opening the can when the top tap is torn off.

Unfortunately, recently the easy-to-open beverage cans seem to be developed toward a trend, that the top tap is not torn off from the can, but still attaches thereto. In use, the top tap is pressed into the can to give an opening. Since the top end of the incorporated straw always lies beneath the top sealing tap, when applied to a can of which the top sealing tap is not detached when the can is opened, the emergence of the straw is likely to be stopped by the top tap still attaching to the can.

Accordingly, it is an object of this invention to provide a device which ensures the emergence of a straw particularly adapted to the beverage can with non-detaching top tap.

According to a feature of this invention, a straw retainer is provided. The retainer comprise two parts pivotally connected together, including a first part fixed beneath the to top tap, and a second floating part which holds the straw. (Note the term "floating" does not refer to buoyant capability, but indicates that the part is not fixed to any portion of the can.) Thus when the top tap is pressed down to release the opening, the first part is pushed downwardly and the second part is pulled toward the opening, thus ensuring the straw retained therein to emergy from the opening.

Numerous features and other advantages will become apparent when read in connection with the accompanying drawing, in which:

DETAILED DESCRIPTION OF PREFERRED EMBODIMENT

Figure 1:
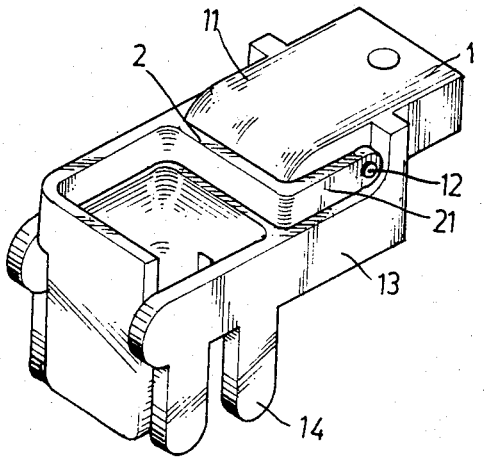
FIG. 1 is a perspective view of this invention.
Figure 2:
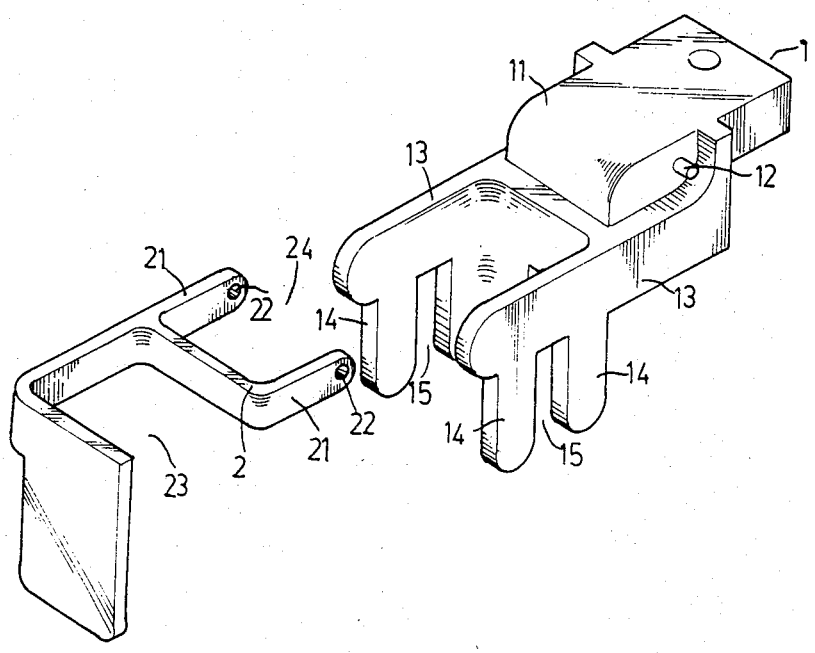
FIG. 2 is a fragmentary view of this invention.
Figure 3:
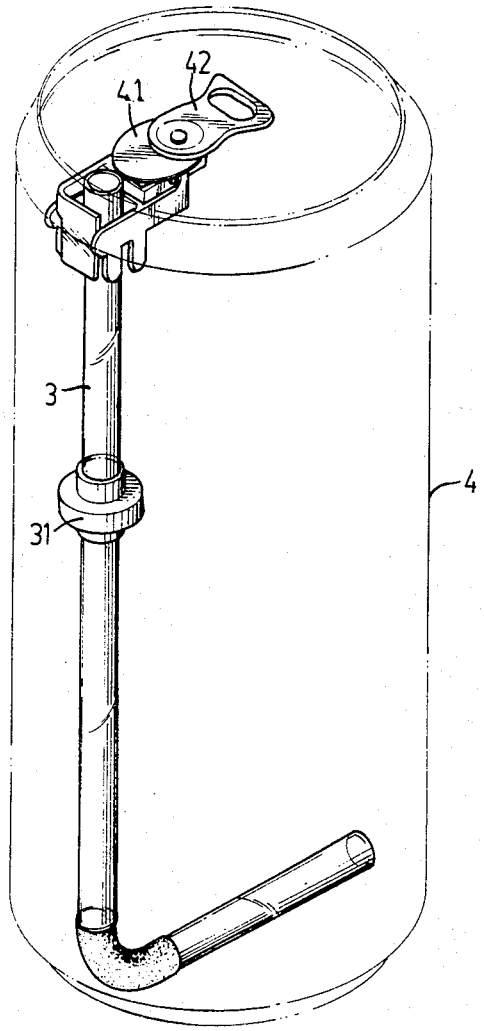
FIG. 3 is a perspective view of this invention in its mounting in a can.

With reference to FIGS. 1, 2 and 3, this invention comprises two main parts: a first part (1) (fixing part) having a tongue (11) fixed to the underside of the top tap (42) of a can (4), and a second part (2) (guiding part) for holding a straw (3) incorporated in the can (4). when one press down tap tongue (41) of the top tap (42), it sinks into the can, thus an opening (5) (see FIG. 5) corresponding to the tap tongue (41) is formed. The floating second part (2) has two arms (21) (21), respectively pivoted to the pivot pins (12) (12) at both sides of tongue (11) with the holes (22) (22) engaging with the pins. Between the two arms (21) (21) is a first recess (24) in which tongue 11 is received. The size of recess (24) must be no smaller than that of the tap tongue so that the latter can sink into the can. The remaining portion of second part (2) defines a slot (23), preferably an open slot to retain a straw (3) in connection with the space (15) formed between the two arms (13) (13) of the first part (1). A plurality of notches (15) forms between the projections (14) at the underside of arms (14) (14). Though not essential, the notches permit a better retaining of the straw. At a distance from its tip, the straw (3) is provided with a float (31) (here the term "float" refers to a buoyant means.) which not only pushes the straw out of the opening when the can is opened, but restricts the length of its emergence, so that the straw will not emerge so excessively that it falls out of the opening. Note the straw is only frictionally held by the float, and if necessary, can be pulled to slide relative to the float. The straw (3) can be provided with hose-like structure (not numbered) to enable it to be bent to any desired angle and the resilience enable the straw to straighten and extends out when the can is opened. The first part is provided with a welding point (not numbered) for spot-welding to the tap tongue (31).

Figure 4:
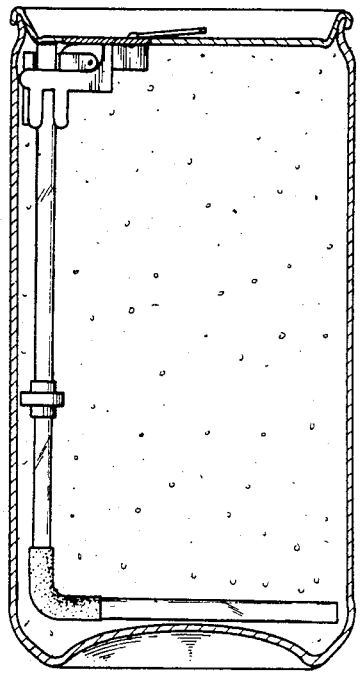
FIG. 4 and FIG. 5 are the graphical representation showing the two states before and after opening the can.
Figure 5:
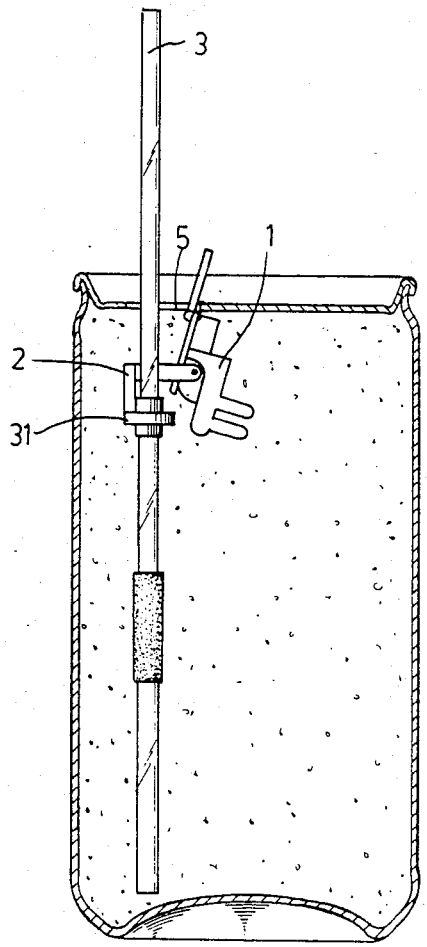
Figure 6:
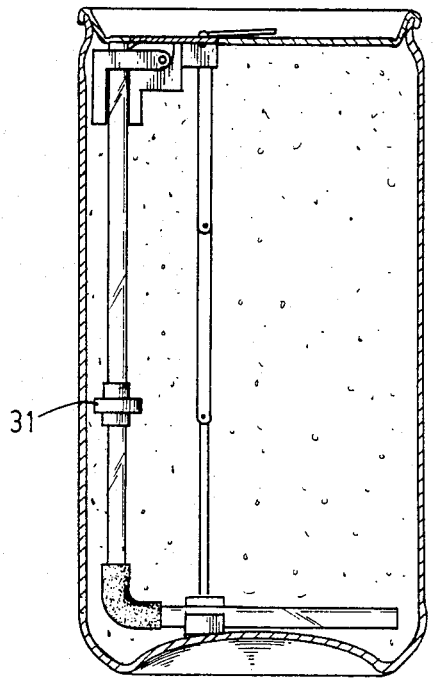
FIG. 6 is shows a modified embodiment of this invention.

With reference to FIGS. 4 and 5, when opening the can (4), apply a force to depress the tap tongue (41) into the can. The junction between the can top and the tap tongue (31) serves as the pivotal axis. Thus the first part (1) swings downwardly around the pivotal axis and the second part (2) is pulled toward the pivotal axis. Since the trajectory of the swinging movement of the first part does not cross with the straw, the emergency of the straw is never hindered thereby. Hence the straw can easily reaches the opening to emerges a proper length therefrom. Accordingly, the device according to this invention makes it possible to incorporated a straw in a beverage can with non-detaching top tap without the risk that its emergence is hindered by the depressed tap tongue.

Figure 7:
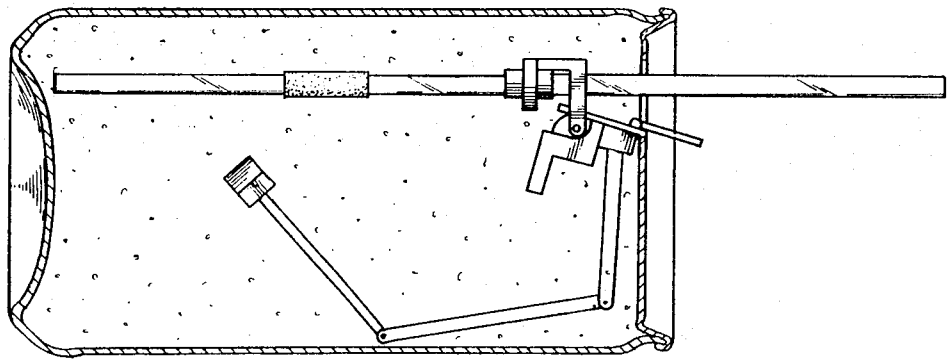
FIG. 7 and FIG. 8 are the graphical representation of the embodiment in FIG. 6, showing the condition before and after the can is opened.
Figure 8:
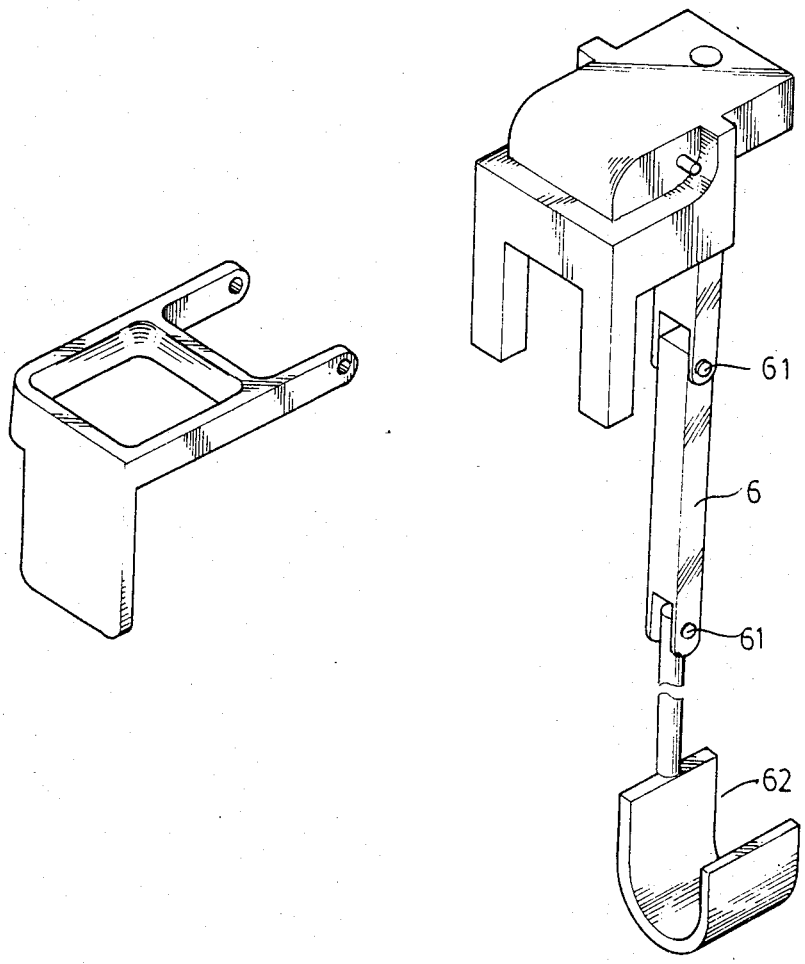
Figure 9:
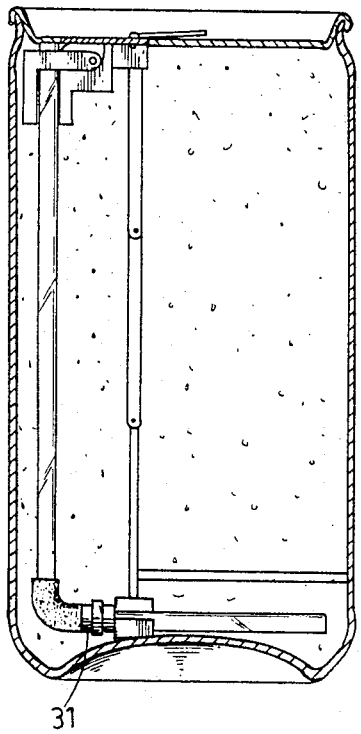
FIGS. 9 to 11 show a sequence of the emergence of the straw of a further embodiment of this invention.
Figure 10:
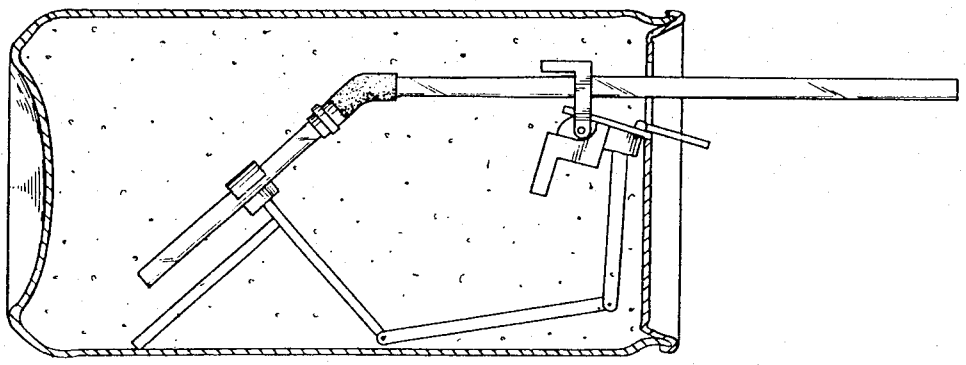
Figure 11:
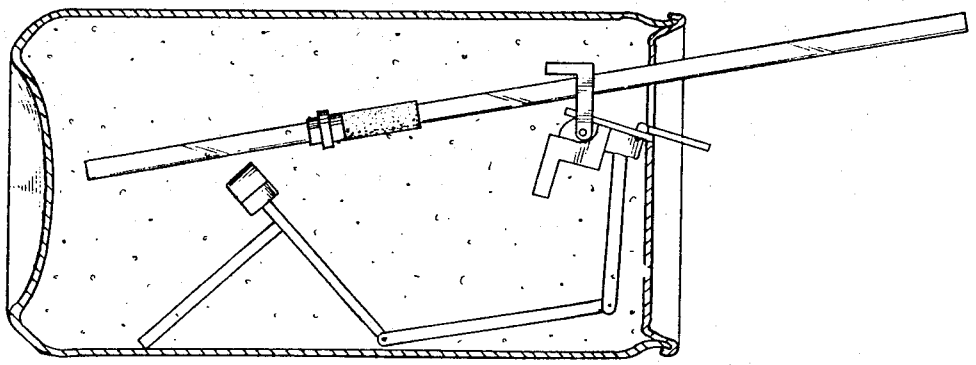

The second part (2) can also have a closed slot (23). Then the first part (1) no longer need an arm to close the open side of the slot. Besides a pivotal (6) which comprises two pivoted joints (61), can be provided for a better holding of the straw. (See FIGS. 7 and 8). The holder (62) of the straw can be a semicircular arcuate piece which opens downwardly or upwardly or alternatively, a cylindrical piece. In the second and third cases, retaining means (63) can be provided to avoid undesired slipping-off of the straw. in the last case it is necessary to ensure that the tubular (cylindrical) holder be erected to a nearly vertical position to facilitate the upward sliding of the straw, there is further provided a rod (64), which is perpendicular to the pivotal arm and rigidly fixed thereto. When the tap tongue (41) is pressed down (see FIGS. 10 to 11) it forces the pivotal arm (6) to bend, and thus ensures the lower portion of the straw can escape from the retaining of the pivotal arm. As seen in FIG. 9, the float (31) can prevent the lower portion of the straw to slip rearwardly (in the FIG. 9 the term "rearwardly" refers to the shift to the right) too much and thus lose its stress which will help its emergence when the can is opened.

I claim:

1. A device to ensure a straw incorporated in an easy-to-open beverage can provided with top sealing tap, said straw being mounted in a manner that when said top sealing tap is opened, said straw can emerge a length from the opening sealed by said top sealing tap, said top sealing tap comprising a sealing portion which seals the opening of said can in an easy-to-open manner and a handle, said handle being disposed in a manner such that when a force is applied to the handle, said sealing portion can pivotally be moved into said can around an swinging axis to release the opening, yet still remain attaching to said can, characterized in that said device comprises a first part fixedly attaching beneath the sealing portion of said sealing tap sealing the opening of said can, and a second part pivotally mounted to said first part, allowing a pivotal movement of said top sealing tap and said first part relative to said second part around an axis;

said second part defining a first recess and a a second recess;

said second recess being structured to retain the upper part a straw;

said first recess being structured to allow the attaching portion with which said first part attaches to said sealing tap, of said first part, and said sealing portion of said sealing tap to pivotally pass through without touching said straw retained in said second recess;

said first and second parts being such that when said can is in sealed state, the top end of said straw is located in the vicinity of the opening of said can, and when said can is opened by pressing said top sealing tap to depress said first part, the top end of said straw is shifted to said opening.

2. The device according to claim 1, wherein said first and second recesses are substantially at the same horizontal level, and said second recess is farther from said opening than is said first recess when said can is in sealed condition.

3. The device according to claim 1, wherein said straw is further provided with float means and bellows-like structure.

4. The device according to claim 1, further comprising additional means to retain the lower part of said straw.

5. The device according to claim 4, wherein said additional means comprising a pivotal arm having at least two pivotal joints along its length, and extending to the bottom of said can, with its lower end forming a structure to retain the lower part of said straw which is bent to lie flat on the bottom of said can.

* * * * *